United States Patent [19]

Moeller et al.

[11] Patent Number: 4,653,291

[45] Date of Patent: Mar. 31, 1987

[54] COUPLING MECHANISM FOR AN EXPANSION DEVICE IN A REFRIGERATION SYSTEM

[75] Inventors: Mark A. Moeller, Indianapolis; Larry J. Burkhart, Ladoga, both of Ind.

[73] Assignee: Carrier Corporation, Syracuse, N.Y.

[21] Appl. No.: 809,559

[22] Filed: Dec. 16, 1985

[51] Int. Cl.[4] ..... F25B 41/06

[52] U.S. Cl. ..... 62/511; 62/527; 138/44

[58] Field of Search ..... 62/511, 527, 528; 138/44, 45; 285/342, 382.7

[56] References Cited

U.S. PATENT DOCUMENTS

| | | | |
|---|---|---|---|
| 3,992,898 | 11/1976 | Duell et al. | 62/527 X |
| 4,009,592 | 3/1977 | Boerger | 62/527 X |
| 4,208,886 | 6/1980 | Maudlin | 62/511 |
| 4,324,112 | 4/1982 | Fujiwara et al. | 62/527 X |

*Primary Examiner*—Lloyd L. King

*Attorney, Agent, or Firm*—Dana F. Bigelow

[57] ABSTRACT

A coupling mechanism is provided for coupling an expansion device in a liquid refrigerant line of a refrigeration system. The coupling mechanism permits the expansion device to be removably coupled to the liquid refrigerant line, thereby permitting the expansion device to be easily decoupled and recoupled to the liquid refrigerant line.

11 Claims, 8 Drawing Figures

COUPLING MECHANISM FOR AN EXPANSION DEVICE IN A REFRIGERATION SYSTEM

BACKGROUND OF THE INVENTION

This invention pertains to refrigeration systems, and more particularly to a coupling mechanism for removably coupling an expansion device to a liquid refrigerant line in a refrigeration system.

In any refrigeration system, the necessity arises for performing preventive or emergency maintenance in the field. For example, one component that may require maintenance in the field is the expansion device or devices that throttle liquid refrigerant flowing in one direction and allow liquid refrigerant to flow uninterrupted in the opposite direction. These expansion devices can become clogged with foreign matter, thus preventing proper and efficient operation of the heat pump.

In some refrigeration systems, the expansion device is secured in place by brazing the device in the liquid refrigerant line between the two heat exchangers. Thus, one of the problems in performing maintenance is that the brazed portion needs to be cut through, or the liquid refrigerant line on either side of the expansion device must be cut through in order to provide access to the interior of the expansion device. After maintenance has been performed as necessary, the field maintenance operator must then rebraze the expansion device into the liquid refrigerant line, or rebraze the two cut portions of the refrigerant line.

When performed in the field, the above requirements of cutting through the brazed connection or the refrigerant pipe and rebrazing as necessary are time consuming, and can be difficult to perform in the field.

Other expansion devices in refrigeration systems attempt to circumvent the above problems by trying to connect the expansion device to the liquid refrigerant line in a removable manner. However, due to the metal-to-metal connection between the expansion device and the liquid refrigerant line, the potential for refrigerant leaks about the metal-to-metal connection are undesirably increased. The existence of any increased potential or possibility of refrigerant leak is unacceptable for obvious reasons.

SUMMARY OF THE INVENTION

It is an object of the present invention to provide an improved connection between an expansion device and a liquid refrigerant line in a refrigeration system.

Another object of the present invention is to provide a coupling mechanism for removably coupling in a fluid tight manner an expansion device in a liquid refrigerant line.

Yet another object of the present invention is to provide a coupling mechanism in a refrigeration system that couples an expansion device in a liquid refrigerant line without the requirement of rebrazing.

A further object of the present invention is to provide a coupling mechanism in a refrigeration system that permits disconnecting the expansion device from a liquid refrigerant line in an easy and quick manner.

Yet a further object of the present invention is to provide a coupling mechanism for coupling an expansion device in a liquid refrigerant line which substantially eliminates the potential of refrigerant leaks thereat.

In one form of the invention, there is provided, in combination, an expansion device having a fluid flow passage disposed therethrough and means in the fluid flow passage for throttling a fluid flowing therethrough; and a coupling mechanism connected to the expansion device and including a retaining means removably fitted in a fluid tight manner at one end of the expansion device and having an opening therethrough in alignment with the fluid flow passage, a liquid supply line having one end thereof fitted in the opening of the retaining means in a fluid tight manner, and a collar means peripherally disposed about the liquid supply line and the retaining means for removably securing the liquid supply line to the expansion device.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF THE PREFERRED EMBODIMENT

Figure 1:
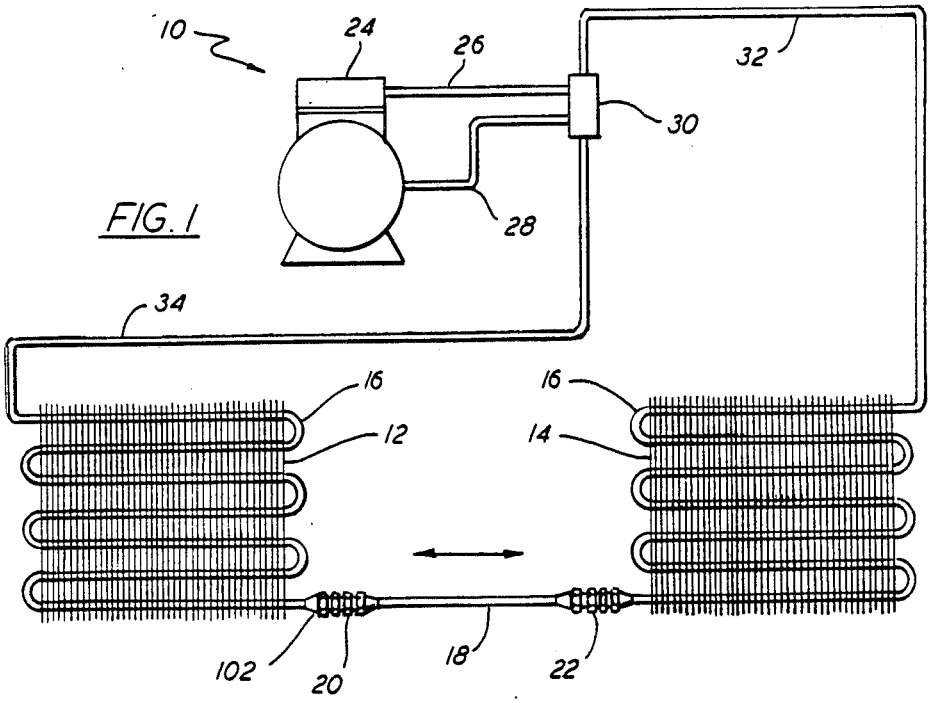
FIG. 1 is a schematic illustration of a typical reversible refrigeration system incorporating a preferred embodiment of the present invention.

Referring to FIG. 1, there is illustrated a typical reversible refrigeration system 10 for providing either heating or cooling. System 10 includes a first heat exchanger 12 and a second heat exchanger 14, each of which contains a refrigerant coil 16. Coil 16 is operatively connected between heat exchangers 12, 14 by a liquid refrigerant line 18 having coupled therein two expansion devices 20, 22, each of which embodies the teachings of the present invention. Compressor 24 is arranged so that the discharge line 26 and the suction line 28 are operatively associated with four-way valve 30. Valve 30 is operatively connected to coil 16 in each heat exchanger 12, 14 by lines 32, 34. By selectively positioning valve 30, the connection to the discharge line 26 and suction line 28 can be reversed between heat exchangers 12, 14, thus providing either a cooling or heating mode as required. The present invention can be used in other types of refrigeration systems besides the reversible type.

Since liquid refrigerant flows in both directions through line 18, two expansion devices, expansion device 20 and expansion device 22, are necessary in order to throttle the liquid refrigerant flowing in one direction to a lower temperature and pressure, and for allowing a flow of liquid refrigerant to flow in the opposite direction virtually uninterrupted. Since both expansion devices 20, 22 are identical, only expansion device 20 will be described.

Figure 2:
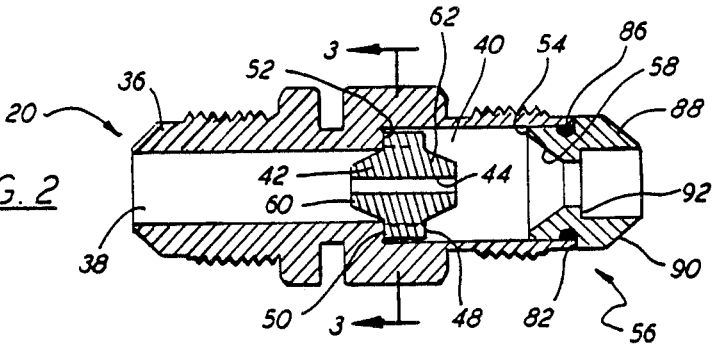
FIG. 2 is a plan view in section of an expansion device employed in the system illustrated in FIG. 1.
Figure 3:
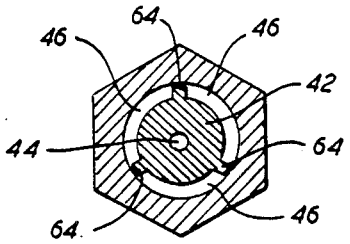
FIG. 3 is a sectional view of FIG. 2 taken along line 3—3 and viewed in the direction of the arrows.

Referring now to FIGS. 2 and 3, expansion device 20 includes a generally cylindrical body 36 having a threaded portion at each end thereof. Fluid flow passage 38 passes into cylindrical body 36 from the left-hand side, as viewed in FIG. 2. The diameter of fluid flow passage 38 is substantially equal to the internal opening of line 18 and is thus capable of supporting the liquid flow passing therethrough. Fluid flow passage 38 opens into an expanded flow passage 40 disposed in the opposite end of body 36.

Free-floating piston 42 is slidably disposed within expanded flow passage 40, and has a centrally located metering port 44 passing therethrough and a plurality of fluid flow channels 46, which are axially aligned with metering port 44, formed in the outer periphery thereof. Piston 42 is permitted to slide freely in an axial direction within expanded flow passage 40. Piston 42 is provided with two flat parallel end faces 48, 50. The left-hand end face 50 is adapted to rest against end wall 52 of expanded flow passage 40, and the right-hand end face 48 is adapted to arrest against annular flat 54 of piston retainer 56, which forms a part of the present invention. The description of piston retainer 56 will be provided in greater detail below.

The depth of each channel 46 formed in piston 42 is less than the radial depth of end wall 52, whereby the channels 46 are closed when piston 42 is arrested against end wall 52 as shown in FIG. 2. When piston 42 is arrested against annular flat 54, channels 46 open directly into tapered opening 58 passing through piston retainer 56. The combined flow area of channels 46 is substantially equal to or slightly greater than the internal opening (not shown) of liquid refrigerant line 18, whereby channels 46 are capable of passing a flow of liquid refrigerant at least equal to that accommodated by line 18.

Piston 42 also includes a left-hand truncated cone end 60 having a circular base at piston end face 50 and possessing a diameter that is slightly less than the internal diameter of fluid flow passage 38. Cone end 60, which is axially aligned with body 36, is positioned within fluid flow passage 38 when piston 42 is moved to its metering position, as illustrated in FIG. 2, thereby properly aligning piston 42 within expanded flow passage 40 to ensure closure of channels 46 against end wall 52. A right-hand cone end 62 has a tapered outer periphery that complements tapered opening 58 of piston retainer 56. When piston 42 is moved to the opposite arrested position against retainer 56, cone end 62 is positioned within tapered opening 58 and coacts therewith to provide an annular passage that tapers from a larger diameter at channels 46 to a smaller diameter at the entrance of liquid refrigerant line 18. As a result, refrigerant flow moving through channels 46 is directed into line 18 with a minimum amount of turbulence. As indicated in FIG. 3, channels 46 are formed by three fins 64 equally disposed circumferentially about piston 42.

For a more detailed explanation of the operation of expansion devices 20, 22 during operation of refrigeration system 10, reference should be made to U.S. Pat. No. 3,992,898 which issued on Nov. 23, 1976 to the assignee of the present invention. U.S. Pat. No. 3,992,898 is hereby incorporated by reference herein.

Eventually, preventive or emergency maintenance may become necessary on either expansion device 20, 22. For example, piston 42 can become clogged or stuck by foreign matter and fail to move fully to the metering position, as illustrated in FIG. 2, or fully to the nonmetering position wherein piston end face 48 abuts annular flat 54 of piston retainer 56. In order for maintenance to be performed, expansion device 20 must be disconnected from liquid refrigerant line 18 in order to clear piston 42 so that it can move or float freely between its metering and nonmetering positions.

Figure 6:
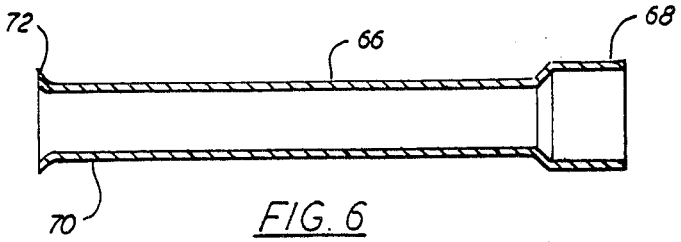
FIG. 6 Prior Art
FIG. 6 is a plan view in section of a prior art tube member.

Referring now to FIG. 6, a prior art method of coupling expansion device 20, for example, in liquid refrigerant line 18 includes providing a pipe 66 having a bell-end 68 and an opposite tube end portion 70. This tube end portion 70 is flared to provide flared tube end 72, which is then placed over the open end of expanded flow passage 40 or the outer surface of an insert disposed therein. Thereafter, a flare nut is threadedly tightened over the threaded end of cylindrical body 36.

In the above method of connecting expansion device 20 in line 18, the potential or possibility of refrigerant leaks is greatly increased due to the metal-to-metal fit between flared tube end 72 and expansion device 20, and also the connection between the flare nut and expansion device 20. Any increased potential in refrigerant leaks is, if not unacceptable, certainly undesirable.

Figure 5:
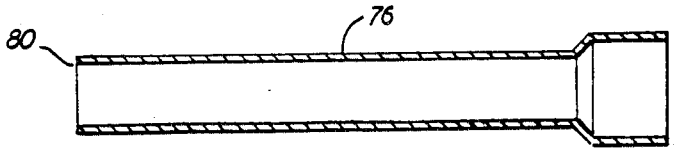
FIG. 5 is a plan view in section of a tube member of the preferred embodiment in FIG. 1.
Figure 8:
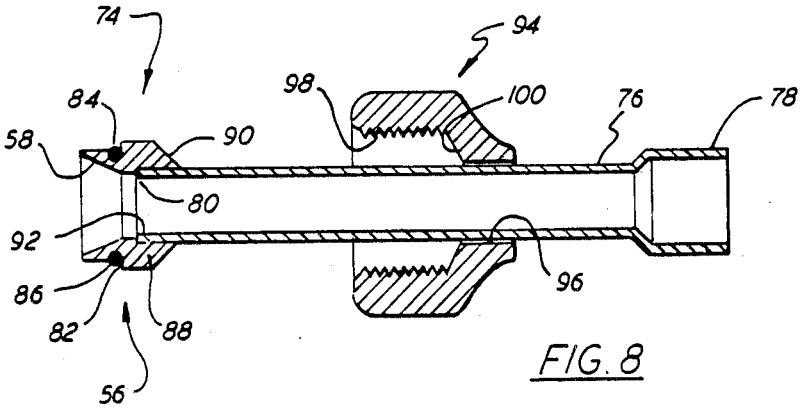
FIG. 8 is a plan view in section of the preferred embodiment in FIG. 1.

To overcome the above problems and to provide an improved coupling mechanism for coupling expansion devices 20, 22 in liquid refrigerant line 18 in a more expeditious and less difficult manner, coupling mechanism 74 of the present invention is provided. Referring to FIGS. 5 and 8, coupling mechanism 74 includes a tube member 76 having a bell end 78 and an opposite straight tube end 80. Tube 76 is not required to have a bell end 78, but one is preferred for easy coupling with another tube, such as a portion of liquid refrigerant line 18, and to hold flare nut or collar 94 captive on tube 76. Opposite straight tube end 80 is described as straight in that it is not flared and is an extension of the cylindrical main body of tube 76.

Figure 4:
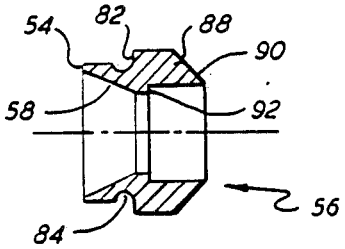
FIG. 4 is a plan view in section of a piston retainer of the preferred embodiment in FIG. 1.

Referring to FIGS. 4 and 8, piston retainer 56 includes an annular shoulder 82 from which extends in one direction a portion thereof including tapered opening 58, annular flat 54, and annular groove 84. This portion of piston retainer 56 is slidably received in expanded flow passage 40. To ensure a fluid tight fit between piston retainer 56 and expansion device 20, O-ring 86 is disposed in groove 84 such that it is compressed between groove 84 and the inner surface of expanded flow passage 40. When installed as indicated in FIG. 2, annular shoulder 82 abuts against the remote end of expanded flow passage 40. Piston retainer 56 also includes a remote end portion 88 that extends externally of expanded flow passage 40 and includes an outer tapered surface 90 that tapers radially inwardly in a direction away from expansion device 20, and an annular ledge 92 disposed in the opening in remote end portion 88.

Figure 7:
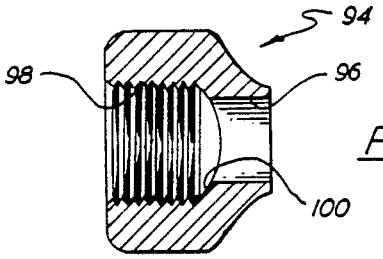
FIG. 7 is a plan view in section of a flare nut of the preferred embodiment in FIG. 1.

Referring now to FIGS. 7 and 8, flare nut 94 includes a smaller opening 96 having an internal diameter just slightly greater than the external diameter of tube member 76, and a threaded hole 98 communicating with opening 96 and which has a threaded inner surface, the diameter of which approximates the outer diameter of the threaded end portion of expansion device 20 defining expanded flow passage 40. Threaded hole 98 and smaller opening 96 join to form a tapered surface 100, which tapers radially outwardly toward piston retainer 56 and expansion device 20.

Coupling mechanism 74 can be assembled and coupled in liquid refrigerant line 18 during the initial manufacturing and assembling thereof. Initially, tube member 76 is received through smaller opening 96 of flare nut 94, such that threaded hole 98 opens toward straight tube end 80.

Thereafter, straight tube end 80 is received in remote end portion 88 of piston retainer 56 such that end 80 abuts against annular ledge 92 with the outer peripheral surface of tube end 80 engaging the inner surfaces of the opening in remote end portion 88, as illustrated in FIG. 8. Tube member 76 is then secured to piston retainer 56, such as by brazing tube end 80 to annular ledge 92. Thereafter, O-ring 86 is tightly received in groove 84. Thus, coupling mechanism 74 exists as a single unit or kit for removably coupling expansion device 20 or 22 in liquid refrigerant line 18.

The opposite end portion of expansion device 20, which is that portion that defines fluid flow passage 38, is secured to coil 16 by means of connector 102 in any suitable fluid tight manner. Thereafter, coupling assembly 74 has piston retainer 56 slidably and removably fitted in expanded flow passage 40 in a fluid tight manner, as indicated in FIG. 2. O-ring 86 ensures a fluid tight fit between piston retainer 56 and expansion device 20, and the brazing of tube end 80 at annular ledge 92 provides a fluid tight fit there. Next, flare nut 94 is moved towards piston retainer 56, which is received in threaded hole 98 such that tapered surface 100 firmly engages tapered surface 90. Both tapered surfaces 90, 100 have planes substantially parallel to the other. By threadedly engaging threaded hole 98 about the threaded end portion of expansion device 20, tapered surface 100 compressively engages tapered surface 90 to secure tube member 76 to expansion device 20. As can be seen, the fluid tight fit of expansion device 20 with liquid refrigerant line 18 is provided by O-ring 86 and the brazing of tube end 80 at ledge 92. The bell end 78 is fixed to line 18 in any suitable fluid tight manner.

If preventive or emergency maintenance is required in the field, it can now be clearly seen that coupling mechanism 74 provides a quick and easy disconnect of expansion device 20, or 22, from liquid refrigerant line 18 to provide access to piston 42 or the replacement thereof when a sweat-type connection is used. Initially, flare nut 94 is threadedly disengaged from expansion device 20, and piston retainer 56, which is secured to tube end 80, is slidably removed from expanded flow passage 40. This permits access to piston 42, and after the necessary maintenance is performed, the recoupling of expansion device 20 in refrigerant line 18 is easily accomplished. All that is required is to reinsert piston retainer 56 in expanded flow passage 40, and then to threadedly secure flare nut 94 to expansion device 20. If necessary, O-ring 86 may be replaced with a new ring to further ensure fluid tight integrity.

The ease and quickness with which expansion devices 20 and 22 can be coupled, uncoupled, and recoupled with liquid refrigerant line 18 in accordance with the principles of the present invention can now be fully appreciated. There is no necessity of cutting through a brazed portion of tube member 76, or of cutting through the intermediate portion of tube member 76, and thereafter requiring the rebrazing of the cut portions. Furthermore, there is no necessity of the maintenance operator to flare the end of any cut tube, as with prior art devices.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a refrigeration system including a compressor having a suction side and a discharge side, a first heat exchanger and a second heat exchanger being connected to said compressor, an expansion device disposed between said heat exchangers and having through one end portion thereof a fluid flow passage that opens through an opposite end portion thereof, said one end portion being connected in fluid communication with one of said heat exchangers, and means disposed in said fluid flow passage for throttling liquid refrigerant, a coupling mechanism for removably coupling said expansion device to the other of said heat exchangers, comprising:

a retainer being slidably and removably fitted in a fluid tight manner at said expansion device opposite end portion and having an opening therethrough in alignment with said fluid flow passage of said expansion device and further having an annular flange disposed in said opening, a liquid supply line having one end thereof connected in fluid communication with said other heat exchanger and the other end thereof securely fitted in said retainer opening in abutting engagement with said annular flange in a fluid tight manner, and a collar means disposed about said liquid supply line and being movable therealong between a first position wherein said collar means is spaced apart from said retainer and a second position wherein said collar means peripherally overlaps said retainer and removably secures said liquid supply line to said expansion device.

2. The system of claim 1 wherein said retainer has an outer surface that tapers radially inwardly in a direction away from said expansion device opposite end portion, said collar means has an inner surface that tapers radially outwardly in a direction toward said expansion device opposite end portion, and said collar means inner surface is compressively engaged about said retainer outer surface at said second position.

3. The system of claim 1 wherein said other end of said liquid supply line is brazed to said retainer.

4. The system of claim 1 wherein said collar means is threadedly secured to said expansion device at said second position.

5. The system of claim 1 and further comprising an O-ring seal between said retainer and said expansion device opposite end portion.

6. In combination, an expansion device having a fluid flow passage disposed therethrough and means in said fluid flow passage for throttling a fluid flowing therethrough to a lower pressure and temperature; and a coupling mechanism connected to said expansion device and including a retaining means removably fitted in a fluid tight manner at one end of said expansion device and having an opening therethrough in alignment with said fluid flow passage, a liquid supply line having one end thereof securely fitted in said opening of said retaining means in a fluid tight manner, and a collar means peripherally disposed about said liquid supply line and said retaining means, said collar means being disposed about said liquid supply line at its one end and being removably secured to said expansion device at its other end.

7. The combination of claim 6 wherein said retaining means further includes an annular flange member in said opening thereof, and wherein said end of said liquid supply line abuts against said annular flange member.

8. The combination of claim 7 wherein said end is brazed to said retaining means.

9. The combination of claim 6 wherein said collar means has an inner surface that tapers radially outwardly in a direction toward said expansion device one end, said retaining means has an outer surface that tapers radially inwardly in a direction away from said expansion device one end, and said inner surface is compressively engaged about said outer surface.

10. The combination of claim 6 and further comprising a seal member between said retaining means and said expansion device.

11. The combination of claim 6 wherein said expansion device further includes a threaded surface portion, and said collar means includes a threaded surface portion, said threaded surface portions being in threaded engagement to secure said liquid supply line to said expansion device.

* * * * *